US006184613B1

(12) United States Patent
Inoue et al.

(10) Patent No.: US 6,184,613 B1
(45) Date of Patent: Feb. 6, 2001

(54) ELECTRODE ASSEMBLY, CATHODE DEVICE AND PLATING APPARATUS INCLUDING A GAP CONFIGURED TO ELIMINATE A CONCENTRATION OF A LINE OF ELECTRICAL FORCE AT A BOUNDARY BETWEEN A CATHODE AND PLATE FORMING SURFACE OF AN OBJECT

(75) Inventors: Satoshi Inoue, Kitasaku-gun; Toyoaki Tanaka, Sakui, both of (JP)

(73) Assignee: TDK Corporation, Tokyo (JP)

( * ) Notice: Under 35 U.S.C. 154(b), the term of this patent shall be extended for 0 days.

(21) Appl. No.: 09/152,787

(22) Filed: Sep. 14, 1998

(30) Foreign Application Priority Data

Sep. 18, 1997 (JP) ..... 9-253992

(51) Int. Cl.[7] ..... H01J 1/20

(52) U.S. Cl. ..... 313/338; 313/446; 313/449; 204/242

(58) Field of Search ..... 313/446, 338, 313/340, 337, 250, 287, 265, 268, 444, 449; 204/280, 286, 288.1, 297.01, 224 R, 242

(56) References Cited

U.S. PATENT DOCUMENTS 3,805,106 * 4/1974 Hooker ..... 313/338
5,700,381 12/1997 Kimura et al. ..... 216/22
5,828,163 * 10/1998 Jones et al. ..... 313/82
5,892,322 * 4/1999 Muchi et al. ..... 313/417

FOREIGN PATENT DOCUMENTS 4-66698 3/1992 (JP) .
5-125596 5/1993 (JP) .

* cited by examiner

*Primary Examiner*—Nimeshkumar D. Patel
*Assistant Examiner*—Joseph Williams
(74) *Attorney, Agent, or Firm*—Oblon, Spivak, McClelland, Maier & Neustadt, P.C.

(57) ABSTRACT

An electrode assembly including a first cathode member provided with a hole enclosed by a frame portion. The frame portion surrounding the hole has a contact surface that comes into contact with an object to be plated at one of its surfaces, and an insulating member is provided with holes and enclosed by a frame portion, with one surface of the frame portion placed on top of another surface of the frame portion of the first cathode member. A second cathode member also provided with a hole enclosed by a frame portion, with one surface of the frame portion placed on top of one surface of the other frame portion of the insulating member. The smallest bore diameter at the hole of the second cathode member is larger than the smallest bore diameter at the holes and of the insulating member.

25 Claims, 7 Drawing Sheets

ELECTRODE ASSEMBLY, CATHODE DEVICE AND PLATING APPARATUS INCLUDING A GAP CONFIGURED TO ELIMINATE A CONCENTRATION OF A LINE OF ELECTRICAL FORCE AT A BOUNDARY BETWEEN A CATHODE AND PLATE FORMING SURFACE OF AN OBJECT

BACKGROUND OF THE INVENTION

1. Field of the Invention

The present invention relates to an electrode assembly, a cathode device and a plating apparatus that may be employed in an ideal manner when plating substrates for various types of electronic components, IC wafers or the like.

2. Discussion of the Background

During the plating process of substrates for various types of electronic components, IC wafers or the like, plating must be implemented within a limited planar area on the object that is to be plated, i. e., the substrate or the wafer. During such a process, plating is performed by placing a cathode device in surface contact with the surface of the object to be plated so that the cathode device encloses the area to be plated. Publications that disclose this prior art technology include Japanese Unexamined Patent Publication No. 66698/1992 and Japanese Unexamined Patent Publication No. 125596/1993. In the cathode devices of the known art disclosed in these publications, a cathode or an auxiliary electrode is placed in surface contact with the object to be plated.

Since this type of cathode device is employed to plate an object to be plated that is constituted of a substrate for an electronic component, an IC wafer or the like, it is crucial that the film thickness distribution be improved by achieving consistency in the plating film thickness at the object to be plated over the entire plate forming surface as a means for forming an element having consistent characteristics within the object to be plated.

However, there is still room for improvement in the consistency of the plating film thickness and the film thickness distribution in the prior art technologies including the technology mentioned above.

SUMMARY OF THE INVENTION

It is an object of the present invention to provide an electrode assembly and a cathode device and a plating apparatus provided with this electrode assembly, with which the film thickness distribution can be improved by achieving consistency in the plating film thickness within the surface where the plate is formed of the object to be plated.

In order to achieve the object described above, the electrode assembly according to the present invention includes a first cathode member, an insulating member and a second cathode member. The first cathode member is provided with a hole enclosed by a frame portion and a contact surface that comes into contact with an object to be plated at one surface of the frame portion. The insulating member is provided with a hole enclosed by a frame portion, with one surface of the frame portion lying adjacent to another surface of the frame portion of the cathode member and the hole concentric with the hole of the first cathode member. The second cathode member is provided with a hole enclosed by a frame portion, with one surface of the frame portion lying adjacent to another surface of the insulating member and the hole concentric with the hole of the insulating member. The smallest bore diameter of the hole at the second cathode member is larger than the smallest bore diameter of the hole of the insulating member.

The cathode device according to the present invention includes the electrode assembly described above. The plating apparatus according to the present invention includes a plating tank, a cathode device and an anode device. The cathode device is the cathode device according to the present invention described above. The cathode device and the anode device constitute an electric circuit for performing plating through a plating bath solution implemented inside the plating tank.

Plating is implemented as required at a plate forming surface (conductive surface) of the object to be plated whose potential is maintained equal to the potential of the cathode in conformance to the line of electric force traveling from the anode to the cathode through the plating bath solution in the plating apparatus described above.

As explained earlier, the electrode assembly employed in the cathode device according to the present invention includes the first cathode member. Since the first cathode member is provided with a contact surface that comes into contact with the object to be plated at one surface of its frame portion, the plate forming surface (conductive surface) of the object to be plated can be placed in contact with the frame portion of the first cathode member.

The cathode device according to the present invention includes the insulating member and the second cathode member in addition to the first cathode member. The first cathode member, the insulating member and the second cathode member are each provided with a hole enclosed by a frame portion, and they are provided adjacent to each other in that order with their holes concentric with one another. Consequently, the plating bath solution can be placed in contact with the plate forming surface (conductive surface) of the object to be plated through the hole of the second cathode member, the hole of the insulating member and the hole of the first cathode member.

Since the insulating member is provided between the second cathode member and the first cathode member, all the components of the electrode assembly can be held in tight contact with one another by taking advantage of the resiliency and the like of the insulating member. By achieving an appropriate degree of hardness (rigidity) in the insulating member, deformation of the insulating member can be prevented while assuring tight contact achieved through its resiliency.

What characterizes the present invention is that in the structure described above, the smallest bore diameter of the hole of the second cathode member is set larger than the smallest bore diameter of the hole of the insulating member. As a result, the internal circumferential edge of the second cathode member is placed at a position receding toward the outside from the internal circumferential edge of the insulating member by a distance represented by the gap occurring due to the difference between the bore diameters of the two members. This structure achieves consistency in the plating film thickness over the entire plate forming surface of the object to be plated.

In a desirable mode, the insulating member includes a first insulating member and a second insulating member. The first insulating member is constituted of a resilient member and is provided with a hole enclosed by a frame portion. The second insulating member, which is constituted of a material that is harder than the first insulating member, is provided with a hole enclosed by a frame portion and is lying adjacent to the first insulating member. The hole at the second insulating member is placed adjacent to the hole of the first insulating member so that they are concentric with each other. In this desirable mode, sufficient tight—contact force is assured through the resiliency of the first insulating member and, at the same time, incorrect positioning, which may otherwise occur due to resilient deformation of the first insulating member, can be prevented by the presence of the second insulating member.

In the mode described above in which the insulating member includes the first insulating member and the second insulating member, it is desirable to set the smallest bore diameter at the insulating member in conformance to the bore diameter of the hole at the second insulating member, since this will create a gap of stable dimension between the internal circumferential edge of the second cathode member and the internal circumferential edge of the insulating member. However, depending upon the material constituting the first insulating member, the bore diameter of the hole at the first insulating member may instead determine the smallest bore diameter at the insulating member.

In another desirable mode, a structure in which the internal circumferential edge of the first cathode member is covered by the first insulating member may be effectively adopted. In this case, since the first insulating member which is not plated is present between the plate forming surface of the object to be plated and the internal circumferential edge of the first cathode member, peeling of the plating film that has been deposited on the object to be plated can be prevented when removing the object to be plated from the cathode device after the plating process is completed. If the internal circumferential edge of the first cathode member is exposed, the plating film will be formed continuously from the plate forming surface of the object to be plated to the internal circumferential edge of the first cathode member, and thus, when disengaging the object to be plated from the cathode device after the plating process is completed, the plating film deposited on the object to be plated may become peeled off.

BRIEF DESCRIPTION OF THE DRAWINGS

Other objects, structural features and advantages of the present invention are explained in further detail by referring to the attached drawings. However, it is to be noted that the attached drawings are only provided as a means for illustrating embodiments.

DETAILED DESCRIPTION OF THE PREFERRED EMBODIMENTS

Figure 1:
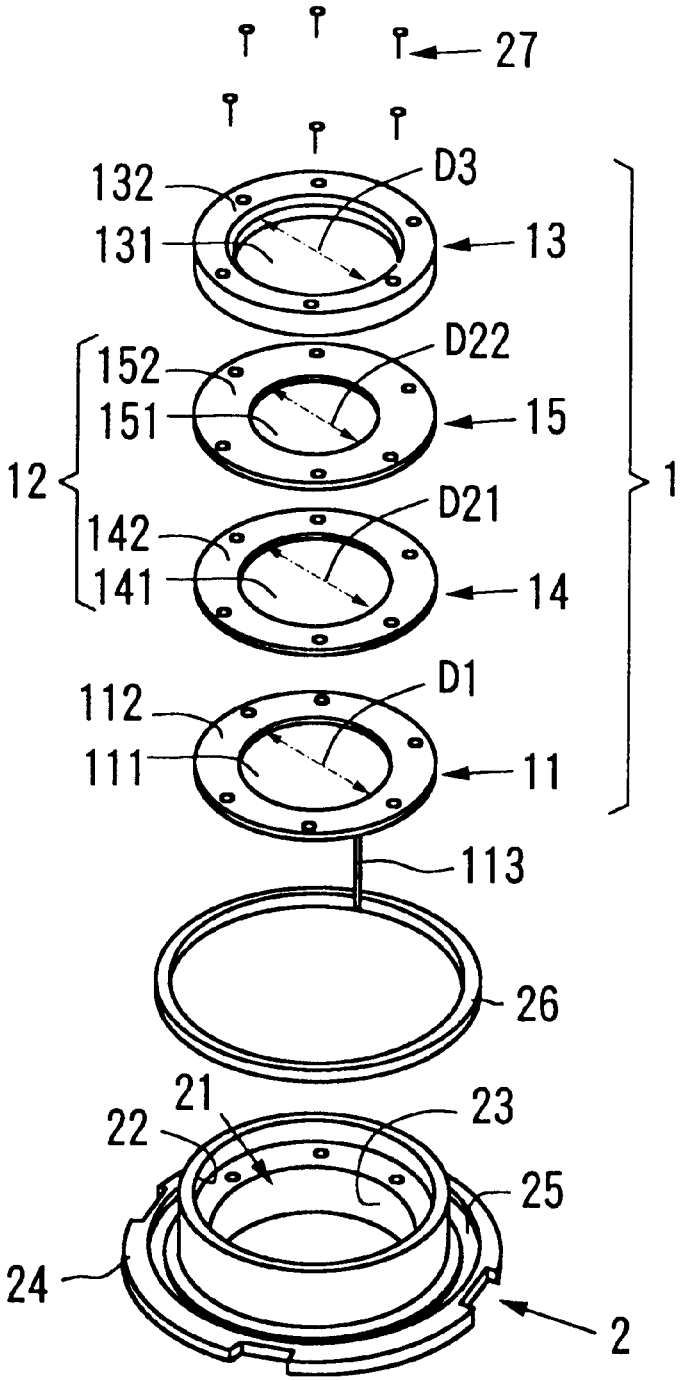
FIG. 1 is an exploded perspective of the cathode device according to the present invention.
Figure 2:
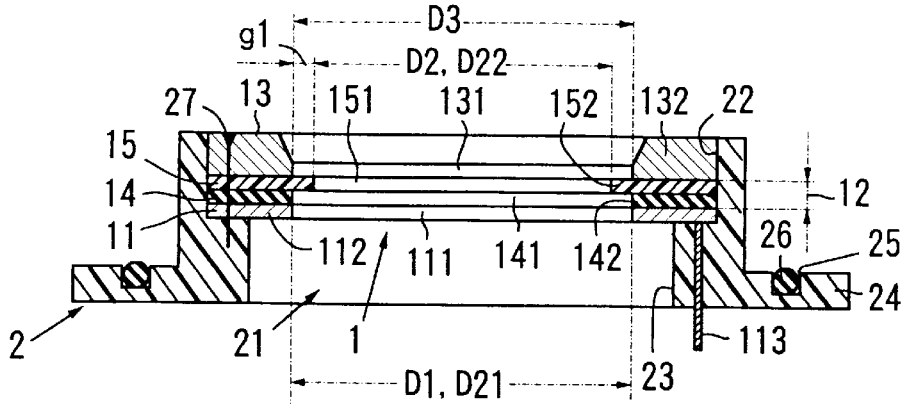
FIG. 2 is a front sectional view of the cathode device according to the present invention in an assembled state.

Referring to FIGS. 1 and 2, the cathode device according to the present invention comprises a first cathode member 11, an insulating member 12 and a second cathode member 13, which, together, constitute an electrode assembly 1. The first cathode member 11 is provided with a hole 111 enclosed by a frame portion 112. The frame portion 112 surrounding the hole 111 is provided with a contact surface that comes into contact with an object to be plated at one of its surfaces (the lower surface in the figures). The first cathode member 11 is constituted by using a conductive material such as a copper plate. The first cathode member 11 is provided with a lead conductor 113.

The insulating member 12, too, is provided with holes 141 and 151 enclosed by frame portions, with one surface of a frame portion (the lower surface in the figure) placed on top of another surface of the frame portion 112 of the first cathode member 11 (the upper surface in the figures).

The second cathode member 13, too, is provided with a hole 131 enclosed by a frame portion 132, with one surface of the frame portion 132 (the lower surface in the figure) placed on top of one surface of the other frame portion of the insulating member 12 (the upper surface in the figures). The second cathode member 13 is constituted of a conductive material such as copper.

The smallest bore diameter D3 at the hole 131 of the second cathode member 13 is set larger than the smallest bore diameter D2 at the holes 141 and 151 of the insulating member 12. Consequently, the internal circumferential edge of the second cathode member 13 is placed at a position which recedes toward the outside from the internal circumferential edge of the insulating member 12 by a distance representing a gap g1 created due to the difference between the bore diameters of the holes at the two members (D3–D1)/2. The size of the gap g1 should be within the range of 0.5 to 2 mm, and it is even more desirable to set it at approximately 1 mm.

In the embodiment, the insulating member 12 includes a first insulating member 14 and a second insulating member 15. The first insulating member 14, which is constituted of a resilient material, is provided with the hole 141 surrounded by a frame portion 142. An example of the material that is to constitute the first insulating member 14 is rubber.

The second insulating member 15, which is constituted of a material harder than that constituting the first insulating member 14, is provided with the hole 151 enclosed by a frame portion 152 and is placed on the first insulating member 14 coaxially. The second insulating member 15 is constituted of a non-conductive material which is harder than that constituting the first insulating member 14 and has chemical resistant properties. A desirable example is PEEK (polyether.ether.keton). Alternatively, the second insulating member 15 may be constituted of engineering plastic having outstanding chemical resistant properties such as vinylchloride.

The bore diameter D21 at the hole 141 provided that the first insulating member 14 is set almost equal to the bore diameter D1 at the hole 111 provided at the first cathode member 11. The bore diameter D22 at the hole 151 of the second insulating member 15 is set smaller than the bore diameters D1 and D21 of the hole 111 provided at the first cathode member 11 and the hole 141 provided at the first insulating member 14. Thus, in the embodiment, the bore diameter D22 at the second insulating member 15 constitutes the smallest bore diameter D2 at the insulating member 12. Through the positioning described earlier, the internal circumferential edge of the second cathode member 13 is placed at a position that recedes toward the outside from the internal circumferential edge of the second insulating member 15 by a distance represented by the gap g1 created by the difference between the bore diameters at the two members (D3–D22)/2.

The embodiment is further provided with a holder 2. The holder 2, which is constituted of an electrically insulating material such as Teflon, polypropylene or vinylchloride, is provided with a through hole 21 constituted by opening its two ends in the axial direction. The through hole 21 includes a first hole portion 22 and a second hole portion 23 so that the electrode assembly 1 can be housed inside the first hole portion 22 and the object to be plated can be inserted in the second hole portion 23. An o—ring 26 is inserted in a circular groove 25 provided at a surface of a collar portion located at one end. A fastener 27, which may be, for instance, a screw constituted of a conductive material such as stainless steel, titanium or the like, secures the electrode assembly 1 at a staged surface of the holder 2 by tightening. Through this fastener 27, the second cathode member 13 is made electrically continuous with the first cathode member 11.

Figure 3:
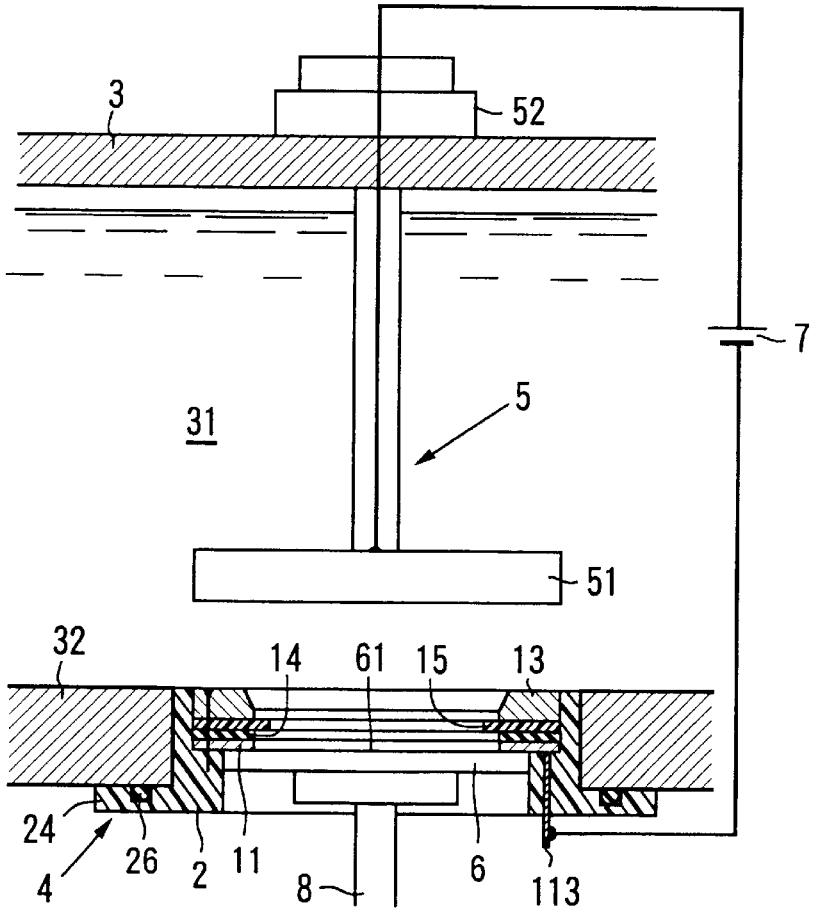
FIG. 3 illustrates the structure of the plating apparatus according to the present invention.

FIG. 3 illustrates the structure of the plating apparatus according to the present invention. The plating apparatus in the figure includes a plating tank 3, a cathode device 4 and an anode device 5. Reference number 6 indicates an object to be plated, reference number 7 indicates a power supply device and reference number 8 indicates a booster device.

The plating tank 3 contains a plating bath solution 31. A bath solution composition which corresponds to the desired plating film should be selected for the plating bath solution 31.

The anode device 5 is positioned so that its anode 51 faces opposite the cathode device 4 via the plating bath solution 31. The anode 51 is supported by a supporting device 52 mounted at the plating tank 3.

The object to be plated 6, which may be, for instance, a substrate for various types of electronic components or an IC wafer, is provided with a plate forming surface 61 constituted of for instance, a plating base film at one of its surfaces. The plate forming surface 61 of the object to be plated 6 is placed in tight contact with the first cathode member 11 by the booster device 8.

The cathode device 4 is placed in tight contact with a supporting plate 32 constituting the bottom portion of the plating tank 3 by the o—ring 26 or the like provided at the holder 2 so that the plating bath solution 31 does not leak from the inside of the plating tank 3. The power supply device 7 is connected between the cathode device 4 and the anode device 5 to apply a DC voltage between them. The first cathode member 11 constituting the cathode device 4 is provided with the lead conductor 113 to which a lead wire led from the power supply device 7 is connected.

The cathode device 4 is provided with the holder 2 which, in turn, is provided with the through hole 21 and supports the electrode assembly 1 that includes the first cathode member 11, the insulating member 12 and the second cathode member 13. Since this structure makes it possible to mount the electrode assembly 1 in advance at the holder 2 before mounting the holder 2 at the plating tank 3, the process for mounting the cathode device 4 at the plating tank 3 is facilitated.

As already described in detail, since the first cathode member 11 of the cathode device 4 according to the present invention has a contact surface that comes into contact with the object to be plated 6 at one surface of the frame portion 112 surrounding the hole 111, the plate forming surface 61 of the object to be plated 6 can be placed in contact with the frame portion 112 of the first cathode member 11. The plate forming surface 61 of the object to be plated 6 is pressed by the booster device 8 so that it comes into tight contact with the frame portion 112 of the first cathode member 11.

Figure 4:
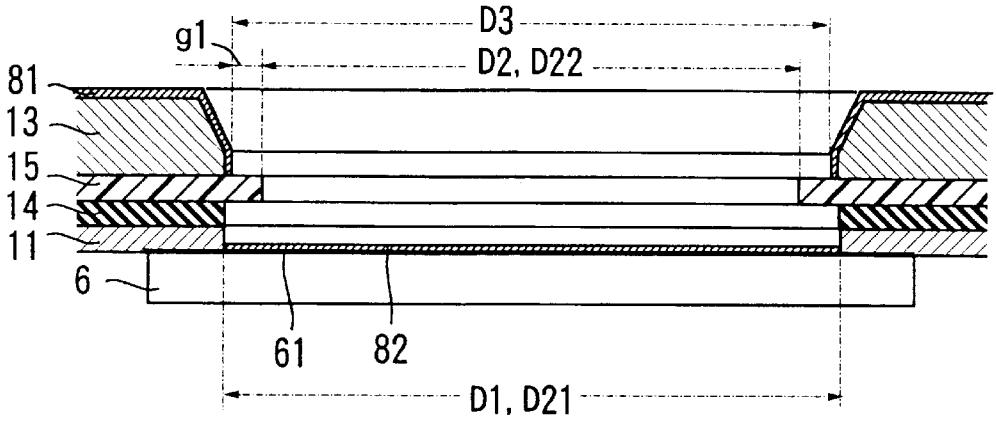
FIG. 4 illustrates deposition of a plating film by the plating apparatus according to the present invention.

In the electrode assembly 1 according to the present invention, since the first cathode member 11, the insulating member 12, and the second cathode member 13 are respectively provided with the hole 111, the holes 141 and 151 and the hole 131 and these holes 111, 141, 151 and 131 are placed adjacent to each other in this order concentric with each other, the plating bath solution 31 can be placed in contact with the plate forming surface 61 of the object to be plated 6 through the holes 141 and 151 of the insulating member 12, the hole 131 of the second cathode member 13 and the hole 111 of the first cathode member 11. Thus, by applying a voltage with the anode 51 as a positive electrode and the first cathode member 11 as a negative electrode, a plating film 82 can be electro—deposited on the plate forming surface 61 of the object to be plated 6, as illustrated in FIG. 4. A plating film 81 is formed at a surface of the second cathode member 31 as well.

Since the insulating member 12 is provided between the second cathode member 13 and the first cathode member 11, the entire electrode assembly 1 can be placed in tight contact by utilizing the resiliency and the like of the insulating member 12. In the embodiment, the insulating member 12 includes the first insulating member 14 and the second insulating member 15 so that sufficient tight—contact force is assured through the resiliency of the first insulating member 14 while preventing incorrect positioning which may otherwise occur due to the resilient deformation of the first insulating member 14 with the presence of the second insulating member 15.

In addition, since the smallest bore diameter D3 at the hole 131 of the second cathode member 13 is set larger than the smallest bore diameter D2 at the holes 141 and 151 of the insulating member 12 and the internal circumferential edge of the second cathode member 13 is placed at a position that recedes toward the outside from the internal circumferential edge of the insulating member 12 by a distance represented by the gap g1 created by the difference between the two smallest bore diameters (D3–D2)/2 in the cathode device according to the present invention, consistency is achieved in the film thickness of the plating film 82 over the entire plate forming surface 61 of the object to be plated 6. The reason for this may be explained as follows.

Namely, when the gap g1 is 0 (a prior art example), a structure in which the second cathode number 13 rises with a stage from a position that is almost dead above the plate forming surface 61 of the object to be plated 6 is achieved. In such a structure, the line of electric force will tend to concentrate in the staged area at the boundary of the second cathode member 13 and the plate forming surface of the object to be plated 6. This induces a phenomenon whereby the plating film thickness becomes reduced particularly in the peripheral area of the object 6 to be plated which constitutes the workpiece.

In contrast, according to the present invention in which the internal circumferential edge of the second cathode member 13 is made to recede toward the outside from the internal circumferential edge of the insulating member 12 by the distance represented by the gap g1 created due to the difference between the bore diameters of the two members (D3–D2)/2, the boundary area which induces concentration of the line of electric force is eliminated by the gap g1 formed by the insulating member 12 between the internal circumferential edge of the second cathode member 13 and the plate forming surface 61 of the object to be plated 6. Thus, consistency is achieved in the film thickness of the plating film 82 at the plate forming surface 61 of the object to be plated 6.

In the embodiment in which the insulating member 12 includes the first insulating member 14 and the second insulating member 15, it is desirable to determine the smallest bore diameter D2 at the insulating member 12 in conformance to the bore diameter D22 at the hole 151 of the second insulating member 15, since this will create a stable gap g1 between the internal circumferential edge of the second cathode member 13 and the internal circumferential edge of the insulating member 12. However, depending upon the material used to constitute the first insulating member 14, the bore diameter D21 at the hole 141 of the first insulating member 14 may determine the smallest bore diameter D2 at the insulating member 12.

Figure 5:
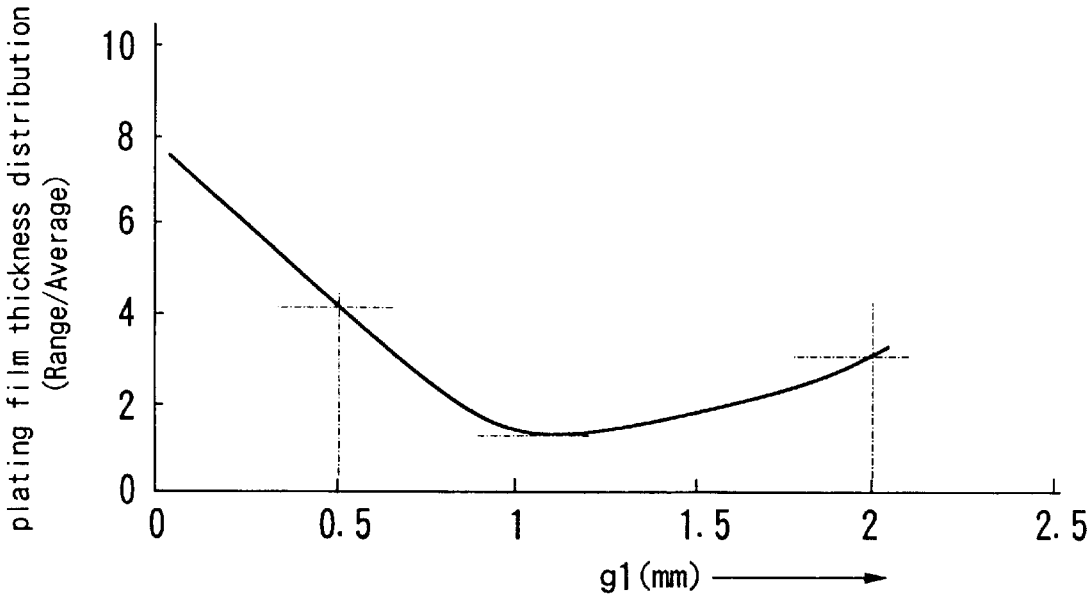
FIG. 5 shows the relationship between the gap g1 and the plating film thickness distribution.

FIG. 5 illustrates the relationship between the gap g1 and the plating film thickness distribution. The plating film thickness distribution is normalized as (Range/Average). The average refers to the average value of the film thicknesses measured at a great number of points within the wafer surface. The range refers to the difference between the maximum value and the minimum value in the results of measurement. As the figure illustrates, the plating film thickness distribution is at its best in the area over which the gap g1 is approximately 1 mm. When the gap g1 is less than 0.5 mm, the plating film thickness distribution deteriorates drastically. In addition, when the gap g1 exceeds 2 mm, the reproducibility in continuous plating becomes poor.

Table I presents the coefficients of film thickness distribution fluctuation occurring when 10 wafers were continuously plated without replacing the cathode device, four types of cathode devices with their gaps g1 at 10 mm, 5 mm, 2 mm and 1 mm were provided, and using each of these cathode devices, continuous plating was performed on 10 wafers. The film thickness measurement was performed using a contact probe level difference meter at the same point in the same row on the individual wafers.

TABLE I

| gl | 10 mm | 5 mm | 2 mm | 1 mm |
|---|---|---|---|---|
| Coefficient of film thickness distribution fluctuation | ±25% | ±12% | ±5% | ±5% |

As the results presented in Table I indicate, when the gap exceeds 2 mm (5 mm or more, for instance) the coefficient of film thickness distribution fluctuation increases to a value more than twice as high as the coefficient achieved when the gap is at 2 mm or less. Furthermore, the coefficient of film thickness distribution fluctuation becomes poor as the gap g1 increases. Thus, a desirable range for the gap g1 is 0.5 mm to 2 mm and even more desirable, the gap g1 should be set at approximately 1 mm.

Figure 6:
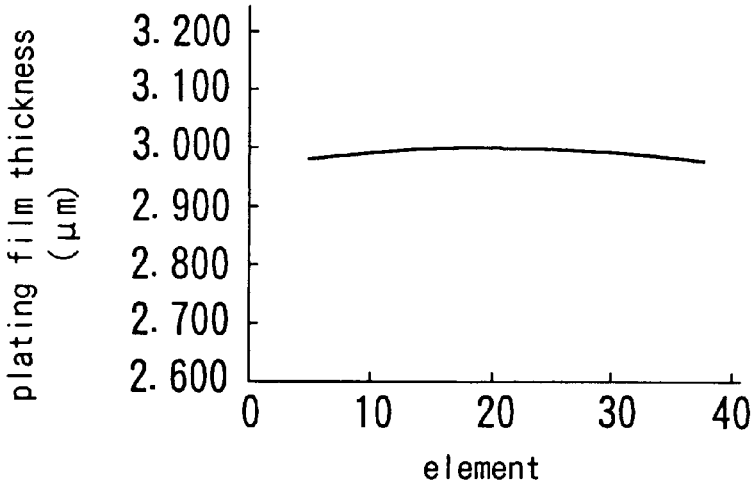
FIG. 6 is a graph presenting the film thickness characteristics on the wafer achieved when the plating apparatus illustrated in FIG. 3 is constituted by employing the cathode device shown in FIGS. 1 and 2.
Figure 7:
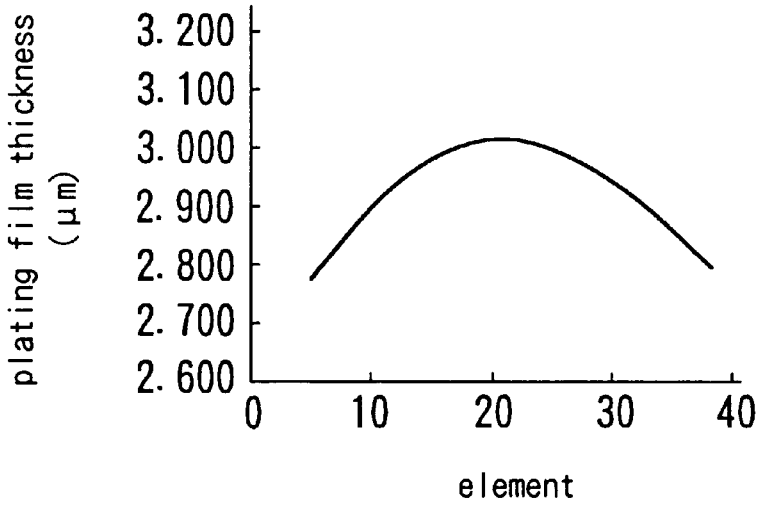
FIG. 7 is a graph presenting the plating film thickness characteristics achieved when the plating apparatus illustrated in FIG. 3 is constituted by employing the cathode device shown in FIGS. 1 and 2 with the gap is set at 0.

FIG. 6 is a graph of the plating film thickness characteristics on a wafer achieved when constituting the plating apparatus illustrated in FIG. 3 by employing the cathode device illustrated in FIGS. 1 and 2. The gap g1 is set at 1 mm. FIG. 7 is a graph of the plating film thickness characteristics achieved by the plating apparatus shown in FIG. 3 and is constituted by employing the cathode device illustrated in FIGS. 1 and 2 with the gap g1 set at 0, and these characteristics represent data of an example for comparison. In FIGS. 6 and 7, the wafer positions are indicated as serial numbers assigned to elements present on an arbitrary line intersecting the wafer. The plating film thicknesses were measured using a contact probe level meter.

As a comparison of FIGS. 6 and 7 clearly indicates, according to the present invention, consistency is achieved in plating film thickness regardless of the position at the wafer, and consequently, the film thickness distribution on the plate forming surface can be improved.

Next, other embodiments of the present invention are explained in reference to FIGS. 8 to 13. In FIGS. 8 to 13, the same reference numbers are assigned to components identical to components in FIGS. 1 to 4.

Figure 8:
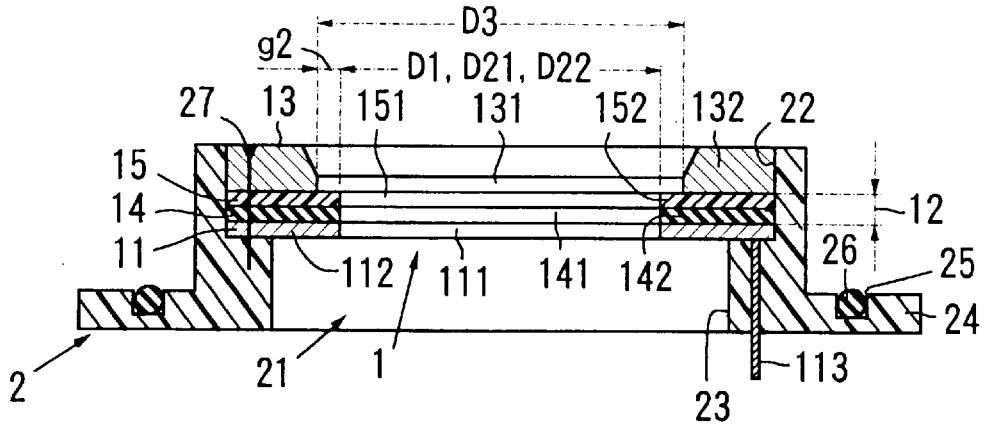
FIG. 8 is a sectional view illustrating another embodiment of the cathode device according to the present invention.

First, in the embodiment illustrated in FIG. 8, the bore diameter D1 at the first cathode member 11, the bore diameter D21 at the first insulating member 14 and the bore diameter D22 at the second insulating member 15 are set almost equal to one another, with the bore diameter D3 at the second cathode member 13 set larger than the bore diameters D1, D21 and D22. The smallest bore diameter D2 at the insulating member 12 is given by the bore diameters D1, D21 and D22, with a gap g2 formed between the internal circumferential edge of the first insulating member 14 and the internal circumferential edge of the second cathode member 13 due to the difference between the bore diameter D2 and the bore diameter D3.

Figure 9:
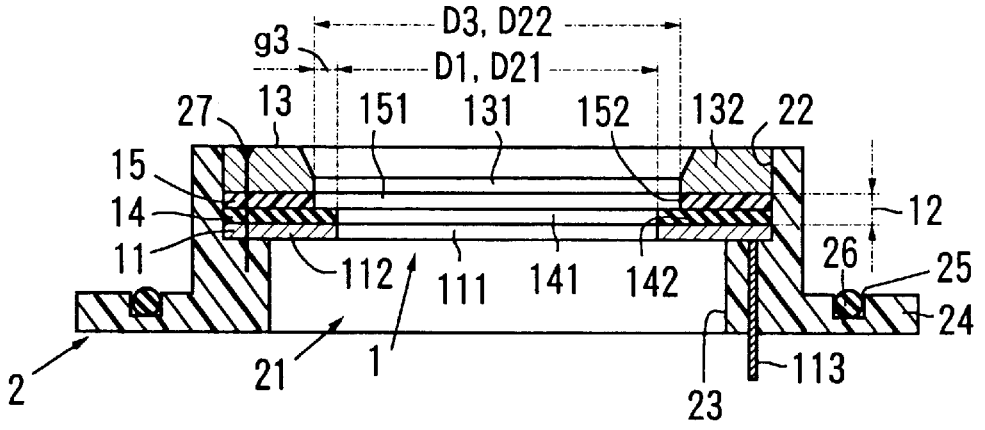
FIG. 9 is a sectional view illustrating yet another embodiment of the cathode device according to the present invention.

In the embodiment illustrated in FIG. 9, the bore diameter D22 at the second insulating member 15 is set almost equal to the bore diameter D3 at the second cathode member 13, and, at the same time, the bore diameter D21 at the first insulating member 14 is set smaller than the bore diameter D22 at the second insulating member 15 and the bore diameter D3 at the second cathode member 13. The smallest bore diameter D2 at the insulating member 12 is given by the bore diameter D21 at the first insulating member 14, with a gap g3 formed between the internal circumferential edge of the first insulating member 14 and the internal circumferential edge of the second cathode member 13 due to the difference between the bore diameter D21 and the bore diameter D3.

Figure 10:
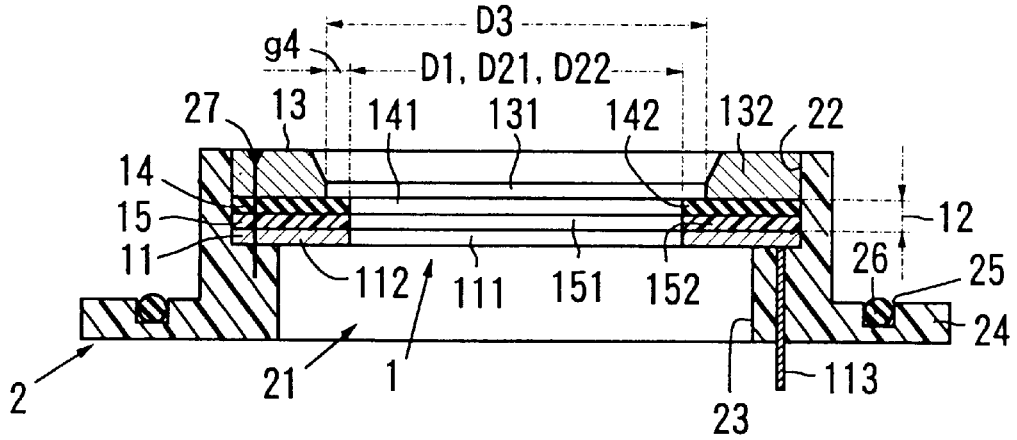
FIG. 10 is a sectional view illustrating yet another embodiment of the cathode device according to the present invention.

In the embodiment illustrated in FIG. 10, the second insulating member 15 is placed over the first cathode member 11 and the first insulating member 14 is placed over the second insulating member 15. The bore diameter D1 at the first cathode member 11, the bore diameter D21 at the first insulating member 14 and the bore diameter D22 at the second insulating member 15 are set almost equal to one another, with the bore diameters D1, D21 and D22 set smaller than the bore diameter D3 at the second cathode member 13. The smallest bore diameter D2 at the insulating member 12 is given by the bore diameters D1, D21 and D22, with a gap g4 formed between the internal circumferential edge of the second insulating member 15 and the internal circumferential edge of the second cathode member 13 due to the difference between the bore diameter D2 and the bore diameter D3.

Figure 11:
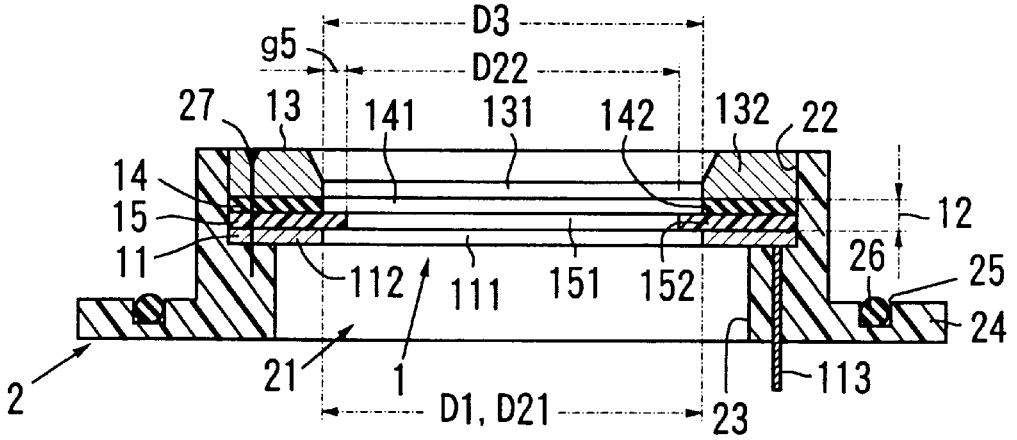
FIG. 11 is a sectional view illustrating yet another embodiment of the cathode device according to the present invention.

In the embodiment illustrated in FIG. 11, in a structure achieved by placing the second insulating member 15 onto the first cathode member 11 and placing the first insulating member 13 onto the second insulating member 15, the bore diameter D21 at the first insulating member 14 and the bore diameter D3 at the second cathode member 13 are set almost equal to each other and the bore diameter D22 at the second insulating member 15 located under the first insulating member 14 is set smaller than the bore diameter D3 at the second cathode member 13. The smallest bore diameter D2 at the insulating member 12 is given by the bore diameter D22 explained above, with a gap g5 formed between the internal circumferential edge of the second insulating member 15 and the internal circumferential edge of the second cathode member 13 due to the difference between the bore diameter D22 and the bore diameter D3.

In these embodiments, too, advantages similar to those achieved in the embodiment illustrated in FIGS. 1 and 2 are realized.

Figure 12:
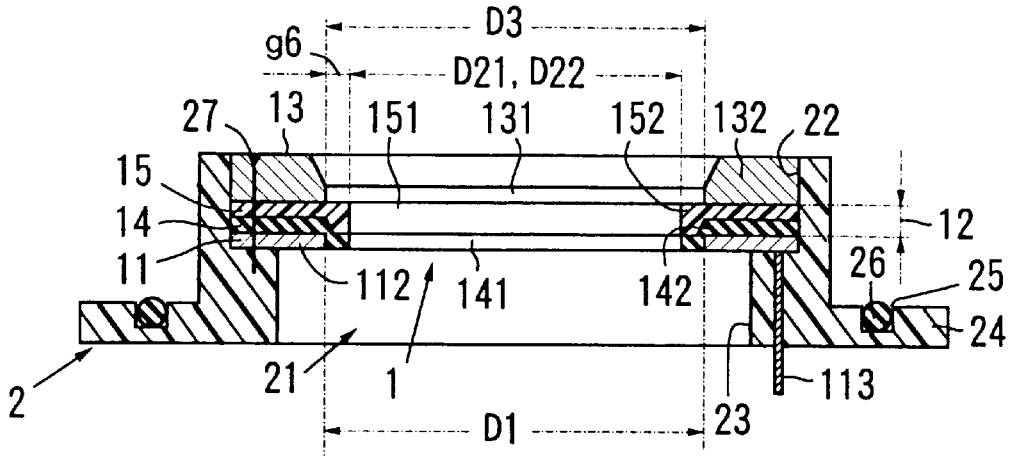
FIG. 12 is a sectional view illustrating yet another embodiment of the cathode device according to the present invention.
Figure 13:
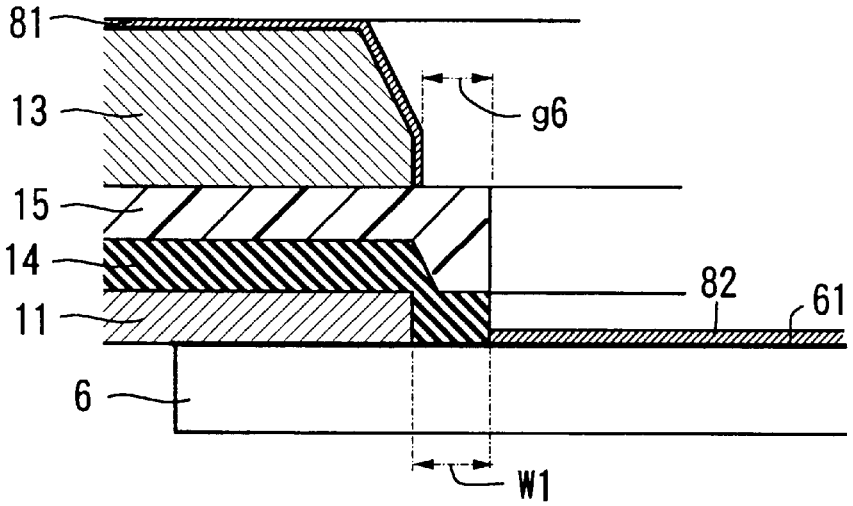
FIG. 13 is a partial sectional view illustrating the advantage of the cathode device illustrated in FIG. 12 in an enlargement.

In the embodiment illustrated in FIG. 12, the first insulating member 14 covers the internal circumferential edge of the first cathode member 11. In this case, since the first insulating member 14 to which no plating film 82 has been deposited is present over a width W1 between the plate forming surface 61 of the object 6 to be plated and the internal circumferential edge of the first cathode member 11, as illustrated in FIG. 13, the plating film 82 deposited on the object 6 to be plated can be prevented from becoming peeled off while removing the object to be plated 6 from the cathode device 4 when the plating process is completed.

In contrast, if the internal circumferential edge of the first cathode member 11 is exposed, the plating film will be formed continuously from the plate forming surface 61 of the object to be plated 6 to the internal circumferential edge of the first cathode member 7. This may cause the plating film 82 deposited on the object to be plated 6 to become peeled when removing the object to be plated 6 from the cathode device 4 after the plating process is completed.

What is claimed is:

1. An electrode assembly comprising a first cathode member provided with a hole enclosed by a frame portion and having a contact surface to come into contact with an object to be plated at one surface of said frame portion;

an insulating member provided with a hole enclosed by a frame portion, with one surface of said frame portion of said insulating member lying adjacent to another surface of said cathode member and said hole of said insulating member being concentric with said hole of said first cathode member; and a second cathode member provided with a hole enclosed by a frame portion, with one surface of said frame portion of said second cathode member lying adjacent to another surface of said insulating member and said hole of said second cathode member being concentric with said hole of said insulating member;

wherein a smallest bore diameter of said hole of said second cathode member is set larger than a smallest bore diameter of said hole of said insulating member so as to form a gap created due to differences between said smallest bore diameter of said hole of said second cathode member and said smallest bore diameter of said hole of said insulating member; and wherein said gap is configured to eliminate a concentration of a line of electrical force at a boundary between said first cathode member and a plate forming surface of said object to be plated.

2. The electrode assembly of claim 1 wherein said insulating member includes:

a first insulating member including a resilient material and having a hole enclosed by a frame portion; and a second insulating member including a material harder than said first insulating member and having a hole enclosed by a frame portion, which is provided adjacent to said first insulating member with said hole of said second insulating member being concentric with said hole of said first insulating member.

3. The electrode assembly of claim 2 wherein the bore diameter of said hole of said first insulating member determines said smallest bore diameter of said insulating member.

4. The electrode assembly of claim 2 wherein the bore diameter of said hole of said second insulating member determines said smallest bore diameter of said insulating member.

5. The electrode assembly of claim 2 wherein said first insulating member is placed on top of said first cathode member; and said second insulating member is placed on top of said first insulating member.

6. The electrode assembly of claim 5 wherein said first insulating member covers an internal circumferential edge of said first cathode member.

7. A cathode device comprising an electrode assembly and a holder;

said electrode assembly being supported by said holder and including:

a first cathode member provided with a hole enclosed by a frame portion and having a contact surface to come into contact with an object to be plated at one surface of said frame portion;

an insulating member provided with a hole enclosed by a frame portion, with one surface of said frame portion of said insulating member lying adjacent to another surface of said cathode member and said hole of said insulating member being concentric with said hole of said first cathode member; and a second cathode member provided with a hole enclosed by a frame portion, with one surface of said frame portion of said second cathode member lying adjacent to another surface of said insulating member and said hole of said second cathode member being concentric with said hole of said insulating member;

wherein a smallest bore diameter of said hole of said second cathode member is set larger than a smallest bore diameter of said hole of said insulating member so as to form a gap created due to differences between said smallest bore diameter of said hole of said second cathode member and said smallest bore diameter of said hole of said insulating member; and wherein said gap is configured to eliminate a concentration of a line of electrical force at a boundary between said first cathode member and a plate forming surface of said object to be plated.

8. The cathode device of claim 7 wherein said insulating member of said electrode assembly includes:

a first insulating member including a resilient material and having a hole enclosed by a frame portion; and a second insulating member including a material harder than said first insulating member and having a hole enclosed by a frame portion, which is provided adjacent to said first insulating member with said hole of said second insulating member being concentric with said hole of said first insulating member.

9. The cathode device of claim 8 wherein the bore diameter of said hole of said first insulating member determines said smallest bore diameter of said insulating member.

10. The cathode device of claim 8 wherein the bore diameter of said hole of said second insulating member determines said smallest bore diameter of said insulating member.

11. The cathode device of claim 8 wherein said first insulating member is placed on top of said first cathode member; and said second insulating member is placed on top of said first insulating member.

12. The cathode device of claim 11 wherein said first insulating member covers an internal circumferential edge of said first cathode member.

13. A plating apparatus comprising:

a plating tank configured to store a plating bath solution;

a cathode device that includes an electrode assembly comprising:

a first cathode member provided with a hole enclosed by a frame portion and having a contact surface to come into contact with an object to be plated at one surface of said frame portion;

an insulating member provided with a hole enclosed by a frame portion, with one surface of said frame portion of said insulating member lying adjacent to another surface of said cathode member and said hole of said insulating member being concentric with said hole of said first cathode member; and a second cathode member provided with a hole enclosed by a frame portion, with one surface of said frame portion of said second cathode member lying adjacent to another surface of said insulating member and said hole of said second cathode member being concentric with said hole of said insulating member, with a smallest bore diameter of said hole of said second cathode member being set larger than a smallest bore diameter of said hole of said insulating member so as to form a gap created due to differences between said smallest bore diameter of said hole of said second cathode member and said smallest bore diameter of said hole of said insulating member, said gap being configured to eliminate a concentration of a line of electrical force at a bound between said first cathode member and a plate forming surface of said object to be plated;

a holder configured to support said electrode assembly; and an anode device as an electrical circuit configured to plate together with said cathode device via said plating bath solution within said plating tank.

14. The plating apparatus of claim 13 wherein said cathode device is mounted at said plating tank so that said object to be plated can be placed in contact with said contact surface of said first cathode member from the outside of said plating tank.

15. The plating apparatus of claim 13 wherein said insulating member of said electrode assembly includes:

a first insulating member including a resilient material and having a hole enclosed by a frame portion; and a second insulating member including a material harder than said first insulating member and having a hole enclosed by a frame portion, which is provided adjacent to said first insulating member with said hole of said second insulating member being concentric with said hole of said first insulating member.

16. The plating apparatus of claim 15 wherein the bore diameter of said hole of said first insulating member determines said smallest bore diameter of said insulating member.

17. The plating apparatus of claim 15 wherein the bore diameter of said hole of said second insulating member determines said smallest bore diameter of said insulating member.

18. The plating apparatus of claim 15 wherein said first insulating member is placed on top of said first cathode member; and said second insulating member is placed on top of said first insulating member.

19. The plating apparatus of claim 18 wherein said first insulating member covers an internal circumferential edge of said first cathode member.

20. An electrode assembly for plating comprising:

a first cathode member provided with a hole enclosed by a frame portion and having a contact surface to come into contact with an object to be plated at one surface of said frame portion;

an insulating member provided with a hole enclosed by a frame portion, with one surface of said frame portion of said insulating member lying adjacent to another surface of said cathode member and said hole of said insulating member being concentric with said hole of said first cathode member; and a second cathode member provided with a hole enclosed by a frame portion, with one surface of said frame portion of said second cathode member lying adjacent to another surface of said insulating member and said hole of said second cathode member being concentric with said hole of said insulating member;

wherein a smallest bore diameter of said hole of said second cathode member is set larger than a smallest bore diameter of said hole of said insulating member so as to form a gap created due to differences between said smallest bore diameter of said hole of said second cathode member and said smallest bore diameter of said hole of said insulating member.

21. An electrode assembly for plating as in claim 20, wherein a range for said gap is 0.5 mm to 2 mm.

22. A cathode device comprising an electrode assembly for plating and a holder;

said electrode assembly for plating being supported by said holder and including:

a first cathode member provided with a hole enclosed by a frame portion and having a contact surface to come into contact with an object to be plated at one surface of said frame portion;

an insulating member provided with a hole enclosed by a frame portion, with one surface of said frame portion of said insulating member lying adjacent to another surface of said cathode member and said hole of said insulating member being concentric with said hole of said first cathode member; and a second cathode member provided with a hole enclosed by a frame portion, with one surface of said frame portion of said second cathode member lying adjacent to another surface of said insulating member and said hole of said second cathode member being concentric with said hole of said insulating member;

wherein a smallest bore diameter of said hole of said second cathode member is set larger than a smallest bore diameter of said hole of said insulating member so as to form a gap created due to differences between said smallest bore diameter of said hole of said second cathode member and said smallest bore diameter of said hole of said insulating member.

23. A cathode device as in claim 22, wherein a range for said gap is 0.5 mm to 2 mm.

24. A plating apparatus comprising:

a plating tank configured to store a plating bath solution;

a cathode device that includes an electrode assembly comprising:

a first cathode member provided with a hole enclosed by a frame portion and having a contact surface to come into contact with an object to be plated at one surface of said frame portion;

an insulating member provided with a hole enclosed by a frame portion, with one surface of said frame portion of said insulating member lying adjacent to another surface of said cathode member and said hole of said insulating member being concentric with said hole of said first cathode member; and a second cathode member provided with a hole enclosed by a frame portion, with one surface of said frame portion of said second cathode member lying adjacent to another surface of said insulating member and said hole of said second cathode member being concentric with said hole of said insulating member, with a smallest bore diameter of said hole of said second cathode member being set larger than a smallest bore diameter of said hole of said insulating member so as to form a gap created due to differences between said smallest bore diameter of said hole of said second cathode member and said smallest bore diameter of said hole of said insulating member;

a holder configured to support said electrode assembly; and an anode device as an electrical circuit configured to plate together with said cathode device via said plating bath solution within said plating tank.

25. A plating apparatus as in claim 24, wherein a range for said gap is 0.5 mm to 2 mm.

* * * * *